US007062185B2

(12) United States Patent
Izumikawa et al.

(10) Patent No.: US 7,062,185 B2
(45) Date of Patent: Jun. 13, 2006

(54) IMAGE FORMING APPARATUS, IMAGE PROCESSING UNIT, AND IMAGE FORMING METHOD TO KEEP IMAGE QUALITY PRECISION OF BOTH SIDES OF RECORDING MEDIUM, AND COMPUTER PRODUCT

(75) Inventors: Manabu Izumikawa, Tokyo (JP); Yukio Tagawa, Tokyo (JP); Takashi Enami, Tokyo (JP); Tatsuo Hirono, Tokyo (JP); Kohichi Kanaya, Tokyo (JP); Masami Miyajima, Tokyo (JP); Shota Miyajima, Tokyo (JP); Takeshi Kowada, Tokyo (JP); Takashi Imori, Tokyo (JP); Takeo Ohashi, Tokyo (JP); Jun Sasaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/942,835

(22) Filed: Sep. 17, 2004

(65) Prior Publication Data

US 2005/0141907 A1 Jun. 30, 2005

(30) Foreign Application Priority Data

Sep. 19, 2003 (JP) ..... 2003-328543
Sep. 10, 2004 (JP) ..... 2004-264477

(51) Int. Cl.
*G03G 15/00* (2006.01)

(52) U.S. Cl. ..... 399/49; 399/309; 399/401

(58) Field of Classification Search ..... 399/38, 399/45, 49, 72, 81, 309, 401
See application file for complete search history.

(56) References Cited

U.S. PATENT DOCUMENTS

| | | | |
|---|---|---|---|
| 4,677,310 | A | 6/1987 | Midorikawa et al. |
| 4,682,158 | A | 7/1987 | Ito et al. |
| 4,799,081 | A | 1/1989 | Kikuno et al. |
| 4,815,725 | A | 3/1989 | Kanaya |
| 4,976,421 | A | 12/1990 | Kanaya |
| 5,012,280 | A | 4/1991 | Tsutsumi et al. |
| 5,110,113 | A | 5/1992 | Kanaya |
| 5,124,759 | A | 6/1992 | Fukuchi et al. |
| 5,131,079 | A | 7/1992 | Miyawaki et al. |
| 5,142,339 | A | 8/1992 | Kasahara et al. |
| 5,146,240 | A | 9/1992 | Hayashi et al. |
| 5,159,392 | A | 10/1992 | Kasahara et al. |
| 5,160,969 | A | 11/1992 | Mizuma et al. |
| 5,162,859 | A | 11/1992 | Hirono et al. |
| 5,165,675 | A | 11/1992 | Kanaya |
| 5,175,760 | A | 12/1992 | Ohashi et al. |
| 5,208,607 | A | 5/1993 | Ohashi et al. |

(Continued)

FOREIGN PATENT DOCUMENTS

| | | |
|---|---|---|
| JP | 9-107476 | 4/1997 |
| JP | 2000-352889 | 12/2000 |

*Primary Examiner*—Hoang Ngo
(74) *Attorney, Agent, or Firm*—Oblon, Spivak, McClelland, Maier & Neustadt, P.C.

(57) ABSTRACT

When a reading unit reads information of a pattern image for correcting image quality printed on at least either side of a recording medium, a control unit compares the information of the pattern image for correcting image-quality with correction pattern information that is a basis of the pattern image for correcting image quality transferred to the at least either side of the recording medium, and controls an image forming unit based on a result of the comparison to correct image quality on the at least either side of the recording medium.

20 Claims, 13 Drawing Sheets

U.S. PATENT DOCUMENTS

| | | | | |
|---|---|---|---|---|
| 5,228,669 | A | 7/1993 | Kanaya | |
| 5,485,246 | A | 1/1996 | Hayashi et al. | |
| 5,510,876 | A | 4/1996 | Hayashi et al. | |
| 5,546,164 | A | 8/1996 | Hayashi et al. | |
| 5,694,201 | A | 12/1997 | Hayashi et al. | |
| 5,784,663 | A | 7/1998 | Hayashi et al. | |
| 5,986,684 | A | 11/1999 | Ohashi | |
| 5,987,227 | A | 11/1999 | Endo et al. | |
| 6,172,699 | B1 | 1/2001 | Ohashi | |
| 6,188,468 | B1 | 2/2001 | Miyajima | |
| 6,226,102 | B1 | 5/2001 | Koike et al. | |
| 6,288,777 | B1 | 9/2001 | Miyajima | |
| 6,687,471 | B1 * | 2/2004 | Sakata et al. | 399/49 |
| 6,961,526 | B1 * | 11/2005 | Tezuka et al. | 399/15 |
| 2002/0015189 | A1 | 2/2002 | Miyajima | |
| 2004/0117389 | A1 | 6/2004 | Enami et al. | |
| 2004/0139164 | A1 | 7/2004 | Kanaya | |
| 2004/0170452 | A1 | 9/2004 | Hayashi et al. | |

* cited by examiner

FIG. 7A

71

AUTOMATIC COLOR CORRECTION FOR DOUBLE-SIDE PRINTING

READS TEST PATTERN FOR SIDE A
AFTER SETTING PAPER PRINTED WITH SIDE-A TEST
PATTERN ON DOCUMENT TABLE, PRESS START KEY.

CANCEL

FIG. 7B

71

AUTOMATIC COLOR CORRECTION FOR DOUBLE-SIDE PRINTING

READS TEST PATTERN FOR SIDE B
AFTER SETTING PAPER PRINTED WITH SIDE-B TEST
PATTERN ON DOCUMENT TABLE, PRESS START KEY.

CANCEL

IMAGE FORMING APPARATUS, IMAGE PROCESSING UNIT, AND IMAGE FORMING METHOD TO KEEP IMAGE QUALITY PRECISION OF BOTH SIDES OF RECORDING MEDIUM, AND COMPUTER PRODUCT

CROSS-REFERENCE TO RELATED APPLICATIONS

The present document incorporates by reference the entire contents of Japanese priority documents, 2003-328543 filed in Japan on Sep. 19, 2003 and 2004-264477 filed in Japan on Sep. 10, 2004.

BACKGROUND OF THE INVENTION

1) Field of the Invention

The present invention relates to a technology for keeping image quality precision of both sides of a recording medium in an image forming apparatus.

2) Description of the Related Art

An ordinary image forming apparatus equipped with a double-side printing function performs double-side printing by transferring an image of a first page, formed on a photoconductor, onto a sheet of paper, fixing the image, then temporarily retaining the sheet in a double-side inverting sheet feeder, feeding the sheet from the double-side inverting sheet feeder in synchronism with the timing of an image of a second page formed again on the photoconductor, transferring the image of the second page onto the sheet, and fixing that image.

Double-side printing onto a sheet of paper using the scheme inevitably requires a double-side inverting sheet feeder and suffers slow first printing in double-side printing since after printing on one side is performed and the sheet is turned over, printing is performed on the other side.

There is an image forming apparatus which has an image forming unit, a transfer unit, and a fixing unit for each side of a sheet on which double-side printing is performed so as to be able to perform double-side printing without using a double-side inverting sheet feeder as a countermeasure to this problem (see, for example, Japanese Patent Application Laid-Open No. 2000-352889).

As the apparatus in the Japanese Patent Application Laid-Open No. 2000-352889 has an image forming unit, a transfer unit, and a fixing unit exclusively for printing on each side of a sheet, however, the mechanical size inevitably becomes large and the cost increases accordingly.

A difference in image quality may occur originated from the number of image transfers and time-variant characteristics of the individual image forming units, transfer units, and fixing units.

Since the configuration for performing double-side printing without using a double-side inverting sheet feeder to speed up double-side printing uses different image forming paths for the respective sides of the sheet, a difference in image quality may occur between the two sides due to the number of image transfers and time-variant characteristics.

SUMMARY OF THE INVENTION

It is an object of the present invention to solve at least the above problems in the conventional technology.

An image forming apparatus according to one aspect of the present invention includes an image forming unit that forms a first visible image based on input image information; a first visible-image carrying unit that transfers the first visible image to form a second visible image, and carries the second visible image; a second visible-image carrying unit that further transfers the second visible image to form a third visible image, and carries the third visible image; a printing unit that performs printing by at least one of transferring the second visible image to one side of a recording medium and transferring the third visible image to other side of the recording medium; a control unit that controls the image forming unit, the first visible-image carrying unit, the second visible-image carrying unit, and the printing unit based on correction pattern information to print a pattern image for correcting image quality on at least either side of the recording medium, the correction pattern information being a basis of the pattern image for correcting image quality transferred to the at least either side of the recording medium; and a reading unit that reads information of the pattern image for correcting image-quality printed on the recording medium. When the reading unit reads the information of the pattern image for correcting image quality printed on the at least either side of the recording medium, the control unit compares the information of the pattern image for correcting image-quality with the correction pattern information, and controls the image forming unit based on a result of the comparison to correct the image quality on the at least either side of the recording medium.

An image processing unit according to another aspect of the present invention includes a control unit that controls an image forming unit, a first visible-image carrying unit, a second visible-image carrying unit, and a printing unit based on correction pattern information to print a pattern image for correcting image quality on at least either side of a recording medium. The correction pattern information is a basis of the pattern image for correcting image quality transferred to the at least either side of the recording medium. When a reading unit reads information of the pattern image for correcting image quality printed on the at least either side of the recording medium, the control unit compares the information of the pattern image for correcting image-quality with the correction pattern information, and controls the image forming unit based on a result of the comparison to correct image quality on the at least either side of the recording medium.

An image forming method according to still another aspect of the present invention includes forming a first visible image based on input image information; transferring the first visible image to form a second visible image, and carrying the second visible image; further transferring the second visible image to form a third visible image, and carrying the third visible image; performing printing by at least one of transferring the second visible image to one side of a recording medium and transferring the third visible image to other side of the recording medium; controlling the forming, the transferring, the further transferring, and the performing based on correction pattern information to print a pattern image for correcting image quality on at least either side of the recording medium, the correction pattern information being a basis of the pattern image for correcting image quality transferred to the at least either side of the recording medium; and reading information of the pattern image for correcting image-quality printed on the recording medium. When the information of the pattern image for correcting image quality printed on the at least either side of the recording medium is read at the reading, the controlling includes comparing the information of the pattern image for correcting image-quality with the correction pattern information and controlling the image forming unit based on a result of the comparing to correct the image quality on the at least either side of the recording medium.

A computer-readable recording medium according to still another aspect of the present invention stores a computer program that realizes the image forming method according to the above aspect on a computer.

The other objects, features, and advantages of the present invention are specifically set forth in or will become apparent from the following detailed description of the invention when read in conjunction with the accompanying drawings.

BRIEF DESCRIPTION OF THE DRAWINGS

FIGS. 7A and 7B are schematics for illustrating examples of the display on the touch panel when the reading of the ACC pattern is checked;

DETAILED DESCRIPTION

Exemplary embodiments of an image forming apparatus, an image processing unit, an image forming method, and a computer product according to the present invention will be explained in detail with reference to the accompanying drawings. The present invention is not limited to the embodiments.

Figure 1:
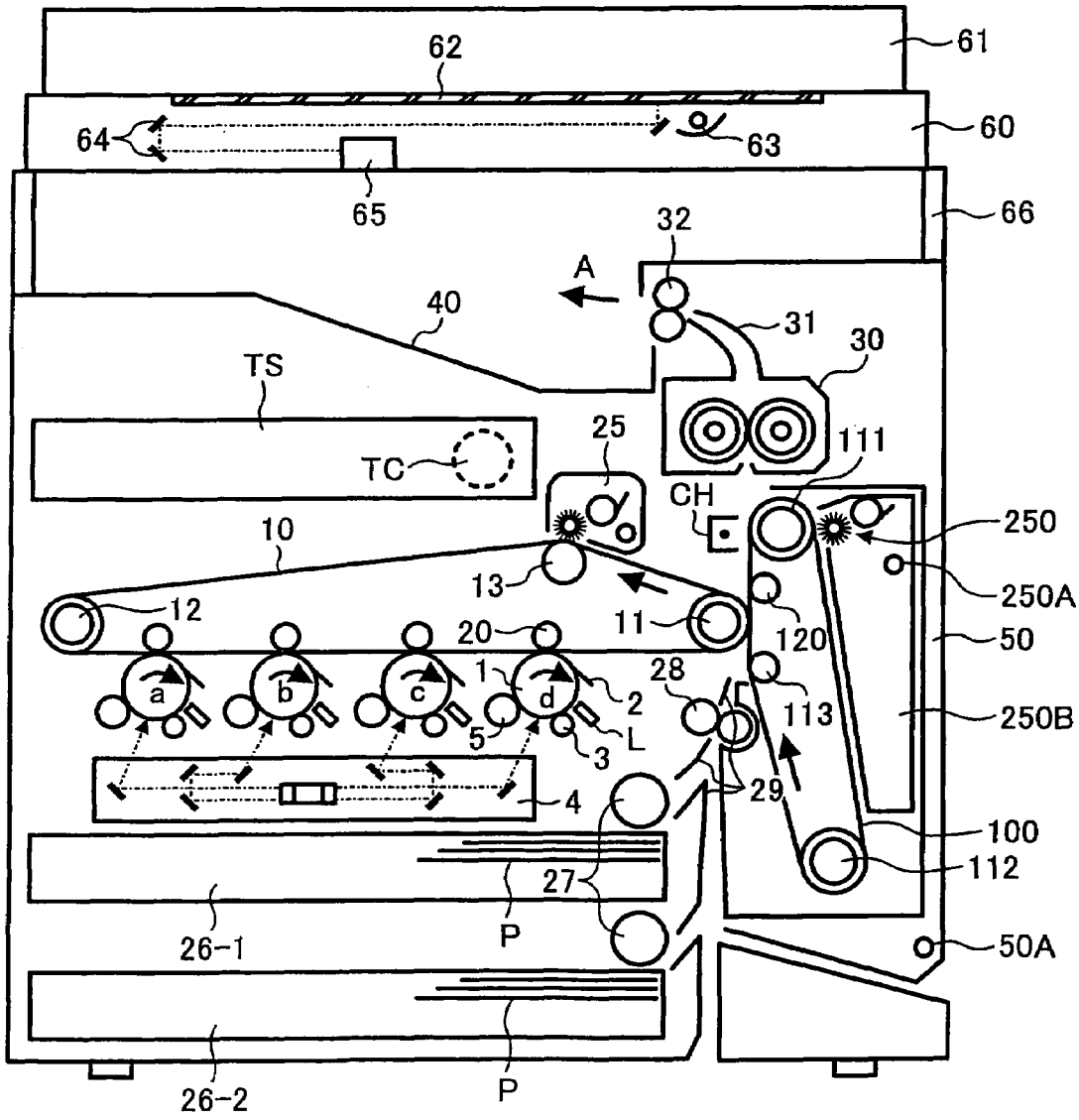
FIG. 1 is a schematic of the configuration of an image forming apparatus according to each embodiment of the present invention.
Figure 2:
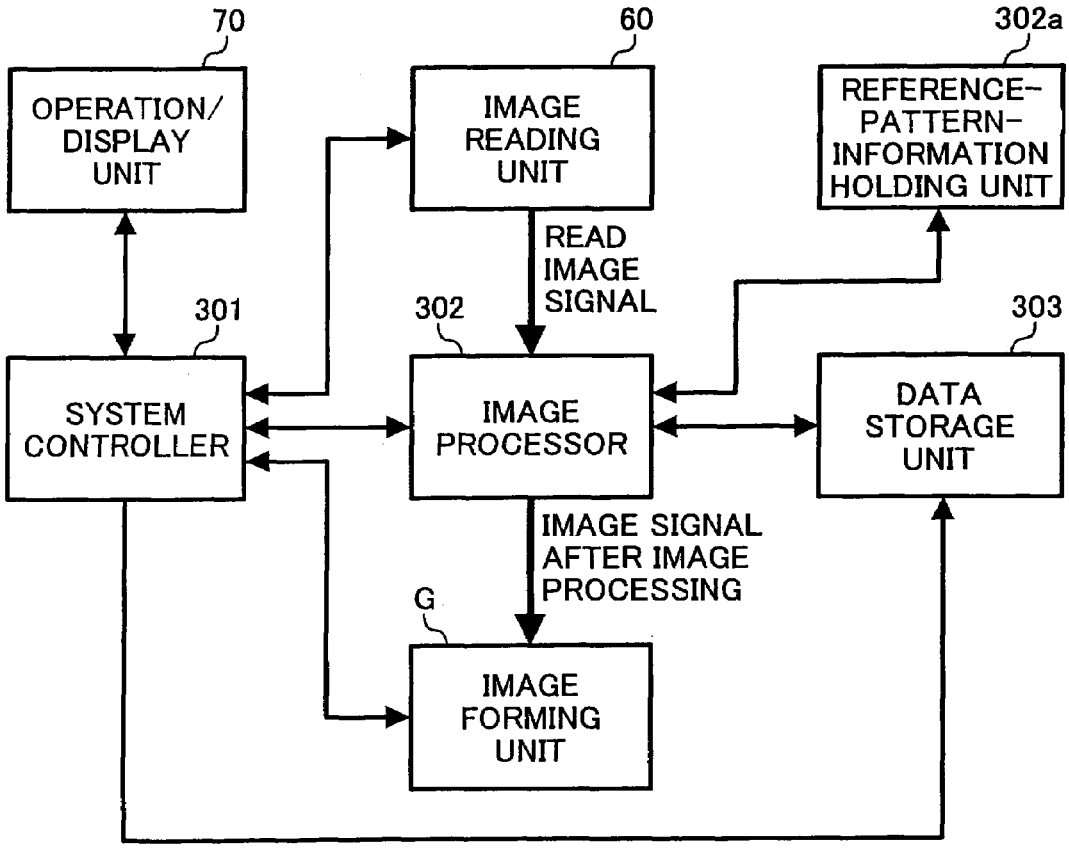
FIG. 2 is a block diagram of a control structure in the image forming apparatus.

FIG. 1 is a schematic of the configuration of an image forming apparatus according to each embodiment of the present invention. FIG. 2 is a block diagram of a control structure in the image forming apparatus.

A configuration of the image forming apparatus according to a first embodiment of the present invention will be explained with reference to FIGS. 1 and 2.

A deelectrifying device L, a cleaning device 2, a charging device 3, and a developing device 5 are laid out around a photoconductor 1 which is supported rotatably and rotates in an arrow direction in FIG. 1. A space where optical information generated from an exposure device 4 is secured between the charging device 3 and the developing device 5 at the outer peripheral portion of the photoconductor 1.

While there are four photoconductors 1 (1*a*, 1*b*, 1*c*, and 1*d*) in the configuration shown in FIG. 1, the photoconductors differ only in the colors of color members (toners) handled by the developing devices 5 and those components for image formation laid around each photoconductor are identical to those around another photoconductor.

The photoconductor 1 is constructed by providing a layer of an organic semiconductor which is a photoconductive material on the top surface of an aluminum cylinder having a diameter of about 30 millimeters to 100 millimeters. A part of the photoconductor 1 contacts an intermediate transfer belt (first visible-image carrying unit) 10.

The intermediate transfer belt 10 is supported by rollers 11, 12, and 13 which rotate, and is stretched movably in an arrow direction in FIG. 1. A first transfer unit 20 is provided at the back side of the intermediate transfer belt 10 (inner side in the loop) near the photoconductor 1 to transfer a visible image on the photoconductor 1 onto the intermediate transfer belt 10.

A cleaning device 25 for the intermediate transfer belt is arranged outside the belt loop of the intermediate transfer belt 10 at the downstream of a position where a visible image is transferred to a recording medium or a back-side intermediate transfer belt (second visible-image carrying unit) 100 from the intermediate transfer belt 10. The cleaning device 25 wipes off unnecessary toners remaining on the top surface of the belt after the visible image is transferred from the intermediate transfer belt 10.

The exposure device 4 is of a known laser type and irradiates optical information corresponding to the formation of a full-color image on the uniformly-charged top surface of the photoconductor 1 as a latent image. The exposure device 4 may include a light emitting diode (LED) array and an image focusing unit.

The photoconductor 1, the cleaning device 2, the charging device 3, the exposure device 4, the developing device 5, the deelectrifying device L, and the first transfer unit 20 function as an image forming unit G that generate a visible image (toner image) to be transferred onto the intermediate transfer belt 10.

The intermediate transfer belt 10 has a base substance of a resin film or rubber of 50 micrometers to 600 micrometers in thickness and has such a resistance as to make toners transferable from the photoconductor 1.

The belt-like back-side intermediate transfer belt (second visible-image carrying unit) 100 is laid out to the right of the intermediate transfer belt 10 in FIG. 1. The back-side intermediate transfer belt 100 is supported by rotatable rollers 111, 112, and 113, and is stretched movably in an arrow direction in FIG. 1. A second transfer unit 120 is provided at the back side of the back-side intermediate transfer belt 100 (inner side in the loop). A cleaning device 250 for the back-side intermediate transfer belt, a charger CH, and the like are laid outside the belt loop of the back-side intermediate transfer belt 100.

The cleaning device 250 wipes off unnecessary toners remaining on the back-side intermediate transfer belt 100 after a toner image is transferred onto a sheet of paper.

The second transfer unit 120, the roller 113, and the roller 11 which supports the intermediate transfer belt 10 cause the intermediate transfer belt 10 and the back-side intermediate transfer belt 100 to contact each other, and form a predetermined transfer nip.

The back-side intermediate transfer belt 100 has a base substance of a resin film or rubber of 50 micrometers to 600 micrometers in thickness and has such a resistance as to make toners transferable from the intermediate transfer belt 10.

A recording medium (paper) P is retained in a sheet feeder (sheet feeding cassette) 26-1 or 26-2 at the lower portion in the diagram, and sheets of paper at the top are conveyed to a pair of resist rollers 28 one by one via a plurality of guides 29.

A heating unit 30 for image fixing, a sheet-discharge guide pair 31, a pair of sheet-discharge rollers 32, and a sheet-discharge stack 40 are laid on a further downstream side where the recording medium P is to be fed out.

A storage unit TS where supplemental toners can be stored is provided above the intermediate transfer belt 10 and below the sheet-discharge stack 40 in FIG. 1. There are four colors of toners of magenta, cyan, yellow, and black each placed in a cartridge TC. A toner is supplemented to a developing device 5 of the corresponding color by a powder pump or the like from the cartridge TC.

A frame 50, which is a part of the main unit of the apparatus, is constructed turnably and openably about an open/close support shaft 50A. Accordingly, a user can widely open the conveyance path for the recording medium by opening the frame 50, facilitating removable of a recording medium (paper) when paper jamming occurs.

An image reading unit 60 is provided at the upper portion of the main unit of the apparatus, which forms an image on the recording medium P, in a connected row arrangement via a support 66. The main unit of the apparatus is constructed in such a way as to ensure a copy operation by printing image data, read by the image reading unit 60, on the recording medium P.

The image reading unit 60 has an auto document feeder (ADF) 61, a contact glass 62, an exposure lamp 63, a plurality of reflection mirrors 64, which reflect reflected light from a document image provided by the exposure lamp 63 and guide the reflected light to a predetermined optical path, and an image sensor array 65 which receives the guided reflected light. The image reading unit 60 is constructed in such a way that one side or both sides of a document can automatically be set on the contact glass 62 in a readable manner and the document image can be read.

Figure 3:
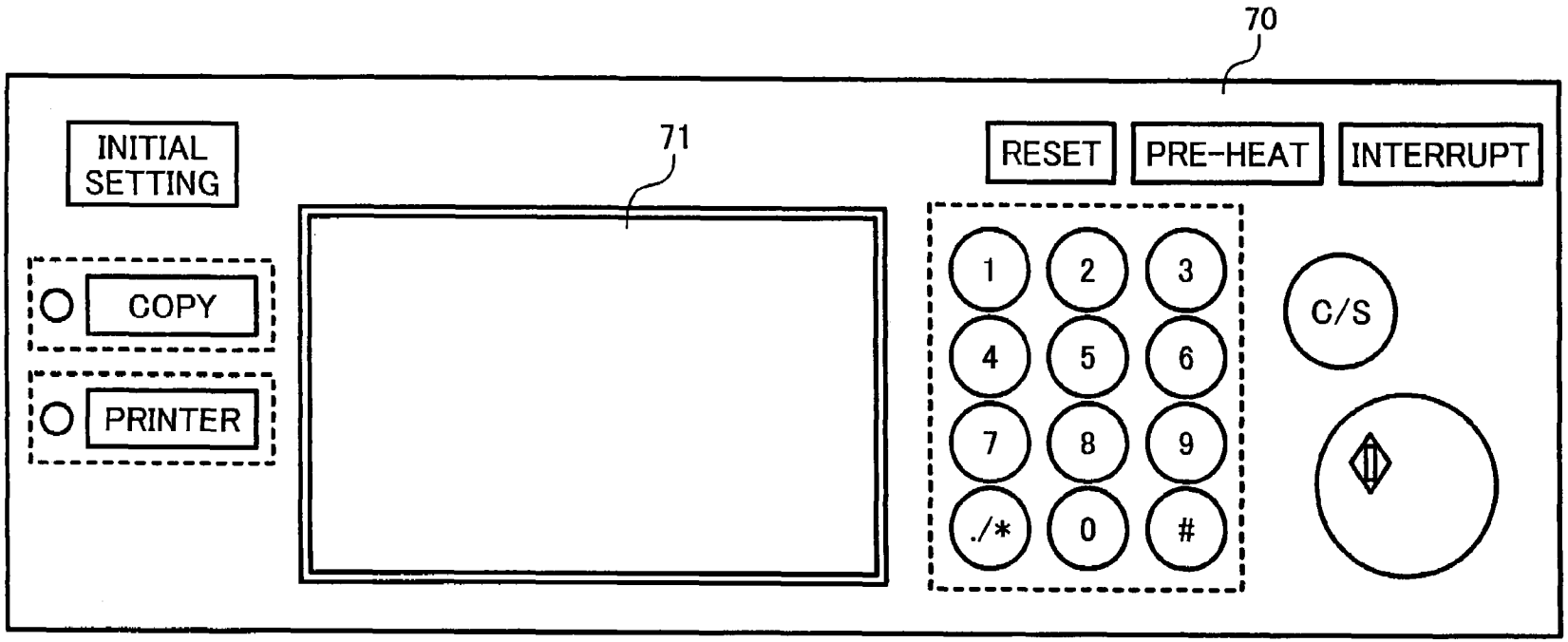
FIG. 3 is a schematic of an operation/display unit.

An operation/display unit (display unit and input unit) 70 as shown in FIG. 3 is provided at the peripheral portion of the image reading unit 60. The operation/display unit 70 has a touch panel 71 which notifies a user of various kinds of operational information by displaying the information and accepts operational inputs, and various buttons, such as ten keys.

Using the operation/display unit 70, a user performs various kinds of operations, such as switching between single-side copying, and double-side copying, starting the copy operation, setting the number of copies, and switching between the copy function and the printer function.

The double-side printing operation of the image forming apparatus according to the embodiment will be explained next. Image forming is performed by the image forming unit G first.

As the exposure device 4 is operated, light from a laser diode (LD) light source, not shown, first reaches the photoconductor 1*a* in the photoconductors 1, which are uniformly charged by the charging device 3 via optical units, not shown, thereby forming a latent image corresponding to write information (information according to the color) on the photoconductor 1*a*.

The latent image on the photoconductor 1*a* is developed by the developing device 5 so that a visible toner image is formed and held at the top surface of the photoconductor 1*a*. The first transfer unit 20 transfers the toner image onto the top surface of the intermediate transfer belt 10, which moves in synchronism with the photoconductor 1*a*.

The toners remaining on the top surface of the photoconductor 1*a* are cleaned off by the cleaning device 2 and the top surface of the photoconductor 1*a* is deelectrified by the deelectrifying device L to be ready for the next image forming cycle.

The intermediate transfer belt 10 carries a toner image transferred onto the top surface and moves in the arrow direction in FIG. 1. Through an operation similar to the operation for the photoconductor 1*a*, a latent image corresponding to another color is written on the photoconductor 1*b* and is developed with a toner of the corresponding color, thereby forming a visible image. The visible image is laid over the visible image of the previous color already transferred onto the intermediate transfer belt 10, so that visible images of four colors formed by the photoconductors 1*a* to 1*d* are eventually laid over one another.

The back-side intermediate transfer belt 100 has moved in the arrow direction in synchronism with the timing of the transfer belt 10, and a visible image transferred onto the top surface of the intermediate transfer belt 10 is transferred onto the top surface of the back-side intermediate transfer belt 100 by the action of the second transfer unit 120.

In the image forming apparatus according to the present embodiment, image formation progresses as the intermediate transfer belt 10 and the back-side intermediate transfer belt 100 are moved while visible images are formed on the four photoconductors 1 in so-called tandem. This structure can shorten the time needed for a step of forming visible images on the photoconductors 1 and transferring the visible images onto the intermediate transfer belt 10 and the back-side intermediate transfer belt 100.

When the intermediate transfer belt 10 moves to a predetermined place, a toner image to be transferred onto the other side (the top side) of the recording medium P is formed again by the image forming unit G in the aforementioned step, and sheet feeding starts.

When the sheet feed roller 27 rotates counterclockwise, the recording medium P at the top in the sheet feeder (sheet feeding cassette) 26 is picked up and fed to the resist roller pair 28.

The second transfer unit 120 transfers the toner image on the top surface of the intermediate transfer belt 10 onto one side (the top side) of the recording medium P, conveyed between the intermediate transfer belt 10 and the back-side intermediate transfer belt 100 through the resist roller pair 28.

The recording medium P is further conveyed upward in FIG. 1 and the toner image on the top surface of the back-side intermediate transfer belt 100 is transferred onto the other side (the back side) of the recording medium P by the charger CH. In the image transfer, the recording medium P is conveyed at a timing controlled by a system control unit 301 in such a way that the image is positioned appropriately.

According to the present embodiment, a toner image to be formed on the photoconductor 1 has a negative polarity. By applying positive charges to the first transfer unit 20, the visible image (toner) formed on the photoconductor 1 is transferred onto the intermediate transfer belt 10. Further, by applying positive charges to the second transfer unit 120, the toner image formed on the intermediate transfer belt 10 is transferred onto the back-side intermediate transfer belt 100.

After the toner image on the top surface of the intermediate transfer belt 10 is transferred onto one side (the top side) of the recording medium P, the charger CH applies positive charges to the back-side intermediate transfer belt 100 so that negative toners on the top surface of the back-side intermediate transfer belt 100 are attracted and are transferred onto the other side (the back side) of the recording medium P.

The recording medium P having toner images transferred on both sides through the operation is fed to the fixing unit 30 that melts and fixes the toner images on both sides of the recording medium P at a time. The resultant recording medium P is discharged to the sheet-discharge stack 40 at the upper portion of the main unit frame via the sheet-discharge guide pair 31 by the sheet-discharge roller pair 32.

When the sheet-discharge stack 40 is constructed as shown in FIG. 1, the side (page) of both sides to undergo double-side printing on which an image is to be formed later by the image forming unit G, that is, the side (the top side) of the recording medium P on which an image is directly transferred from the intermediate transfer belt 10 is placed down on the sheet-discharge stack 40. For arrangement by pages, therefore, the image of the second page should be formed first by the image forming unit G and its toner image (visible image) should be held on the back-side intermediate transfer belt 100 before the image of the first page is directly transferred onto the recording medium P from the intermediate transfer belt 10.

An image to be transferred onto the top side of the recording medium P from the intermediate transfer belt 10 is formed by exposure in such a way as to be a normal image on the top surface of the photoconductor 1, and a toner image to be transferred onto the back side of the recording medium P from the back-side intermediate transfer belt 100 is formed by exposure in such a way as to be a reverse image (mirror image) on the top surface of the photoconductor 1.

The image forming procedures for arrangement by pages can be accomplished by using a known technology of storing image data in a storage unit (memory). The exposure of images to be formed in such a way that the images are switched between a normal image and a reverse image (mirror image) can be accomplished by using a known image processing technology.

After the toner image is transferred onto the recording medium P from the back-side intermediate transfer belt 100, the cleaning device 250 which incorporates a brush roller, a collecting roller, a blade, and the like, all of known types, cleans off unnecessary toners or paper powder remaining on the top surface of the back-side intermediate transfer belt 100.

The brush roller 250 is set apart from the top surface of the back-side intermediate transfer belt 100 in FIG. 1. The brush roller 250 is provided swingably about a fulcrum 250A and can come in contact with or away from the top surface of the back-side intermediate transfer belt 100.

Before transferring the toner image, transferred from the intermediate transfer belt 10, onto the recording medium P, that is, when the back-side intermediate transfer belt 100 is carrying the toner image, the brush roller 250 is set apart from the top surface of the back-side intermediate transfer belt 100, whereas when image transfer to the recording medium P is performed and cleaning is needed, the system control unit 301 swings the brush roller 250 counterclockwise in FIG. 1 so that the brush roller 250 contacts the top surface of the back-side intermediate transfer belt 100.

The removed unnecessary toners are collected on a toner collecting unit 250B.

The outline of the control in automatic color correction (ACC) in the image forming apparatus according to the present embodiment will be described next. In FIG. 2, thick lines indicate the flow of image data and thin lines indicate the flow of control data.

Figure 4:
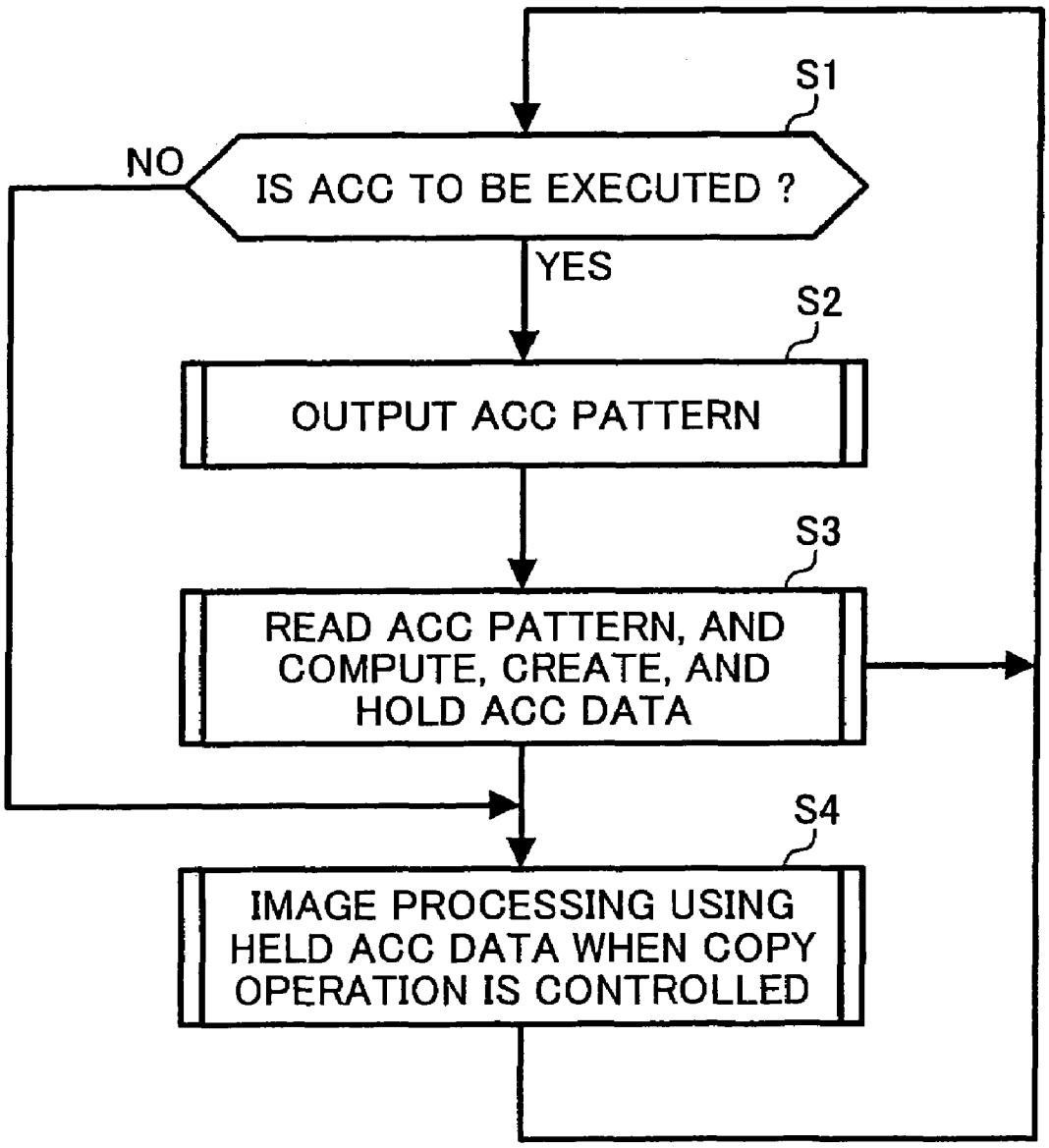
FIG. 4 is a flowchart of the outline of the operation for automatic color correction (ACC) in each embodiment.

FIG. 4 is a flowchart of the outline of the operation for automatic color correction (ACC) according to the present embodiment.

An image signal of a document read by the image reading unit 60 (read image signal) is input to an image processor 302 where the image signal undergoes necessary image processing. Thereafter, the image forming unit G forms a visible image by toners, the visible image is transferred onto the recording medium P via the intermediate transfer belt 10 and the like to form (output) an image under the control of the system control unit 301.

The system control unit 301 and the image processor 302 function as a control unit that controls image forming, image transfer, image output, and the like in the image forming apparatus as explained above.

Figure 5:
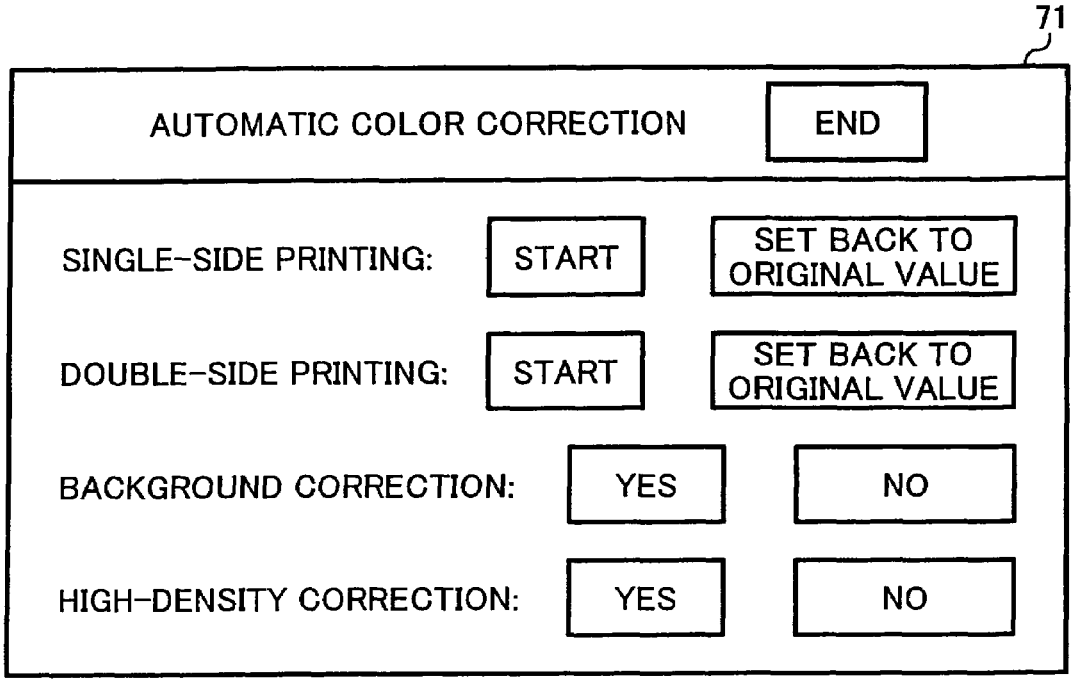
FIG. 5 is a schematic for illustrating an example of a display on a touch panel when the ACC operation is started.

At the time of executing ACC, a screen as shown in FIG. 5 is displayed on the touch panel 71 and as a user presses the "START" button for ACC for single-side copying or double-side copying, the ACC operation starts (step S1).

Figure 6:
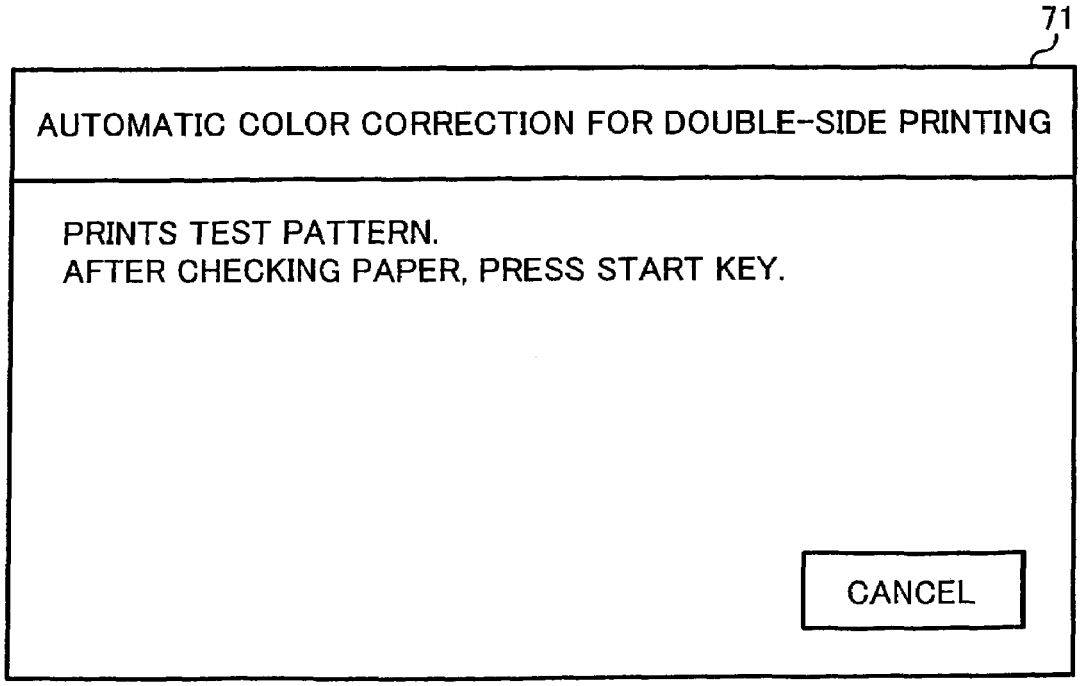
FIG. 6 is a schematic for illustrating an example of the display on the touch panel when the output of the ACC pattern (image-quality correction pattern) is checked.

When an input is made to initiate ACC for double-side copying, a guide screen as shown in FIG. 6, for example, is displayed on the touch panel 71. When the start key on the operation/display unit 70 is pressed, the image forming apparatus starts printing an ACC pattern (test pattern; image-quality correction pattern) for each side.

A reference pattern information holding unit 302*a* shown in FIG. 2 holds reference pattern information as data for generating an ACC pattern to be printed on both sides of a recording paper. The image processor 302 accesses the reference pattern information holding unit 302*a* and reads the reference pattern information held therein. The reference pattern information holding unit 302*a* is held in a non-volatile memory device, such as a read only memory (ROM). Alternatively, the reference pattern information holding unit 302*a* may be a writable non-volatile memory device.

The ACC pattern is output as image signals for individual sides from the image processor 302 is processed to from images on two recording mediums P by the image forming unit G or the like in the operation described above (step S2).

When the ACC pattern is output, a guide screen as shown in FIG. 7A, for example, is displayed on the touch panel 71 and a voice is generated from a speaker (voice output unit), not shown, to prompt a user to set the recording medium P to which the ACC pattern (test pattern) for the top side (side A) has been output onto a document table.

Figure 8:
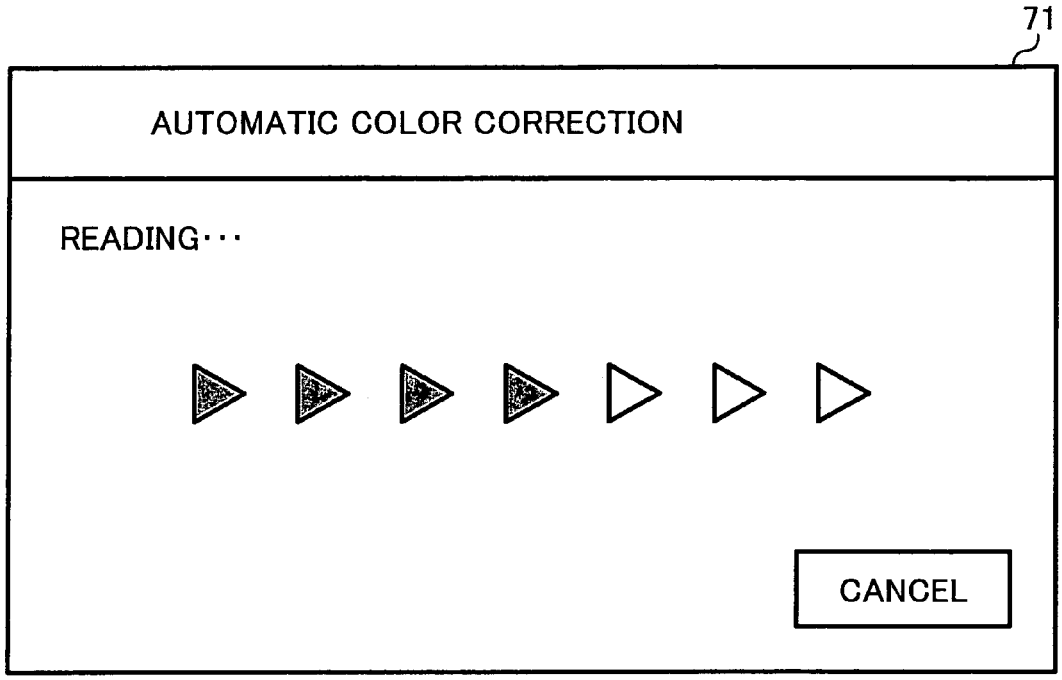
FIG. 8 is a schematic for illustrating an example of the display on the touch panel during reading of the ACC pattern.

The image reading unit 60 reads the ACC pattern and the image processor 302 compares the read image signal with the reference pattern information, held in the reference pattern information holding unit 302*a*, for analysis and computes and creates ACC data (color correction data). The generated A-side ACC data is input to a data storage unit 303 and stored there. At this time, a screen as shown in FIG. 8, for example, is displayed on the touch panel 71.

For the back side (side B), likewise, a guide screen as shown in FIG. 7B to prompt the user to set the recording medium P on the document table is displayed and such prompt is also given in a voice. Likewise, reading of an image signal, computation of ACC data, and storage of the ACC data are executed (step S3).

In the image reading operation at the step S3, a guide screen is displayed on the touch panel 71 or a voice notification is made through the speaker, prompting the user to check the side A or the side B and set the recording medium P printed with the ACC pattern for a predetermined side on the document table in a readable manner. Instead, the image forming apparatus according to the present embodiment may be equipped with an automatic identification function of automatically identifying whether the set ACC pattern is for the side A or the side B.

In the modification, a user may be prompted to set an ACC pattern without designation of the side, and when the image reading unit 60 reads the set ACC pattern, the image processor 302 may automatically identify, from the read image signal, whether the read ACC pattern is for the side A or the side B.

When double-side copying is performed after the ACC computation is performed, the image processor 302 performs image processing on the image data, read by the image reading unit 60, using the stored ACC data as a feedback value and images are formed on the individual sides of the recording medium P in the manner described above (step S4).

By using the feedback value obtained by reading the ACC pattern output to the recording medium P, image formation by the image forming unit G at the time of forming image data, read by the image reading unit 60, on the recording medium can be performed by the optimized image processing, so that the optimal image processing that copes with time-dependent changes or the like in the image forming unit G, the intermediate transfer belt 10, and the back-side intermediate transfer belt 100 can be carried out.

The ACC operation may be the one disclosed in Japanese Patent Application Laid-Open No. H9-107476 applied by the present applicant, or may be another arbitrary image-quality correcting scheme, such as color correction or any of various gradation processes. Since the individual correcting schemes are known techniques, their descriptions will be omitted.

The details of the ACC operation of the image forming apparatus according to the present embodiment, explained with reference to FIG. 4 is explained below.

In the ACC operation, as mentioned above, the A-side ACC pattern is transferred onto a single recording medium by the intermediate transfer belt 10, the B-side ACC pattern is transferred onto another recording medium by the back-side intermediate transfer belt 100, and both ACC patterns are read to create color correction data which depends on the respective visible-image carrying units.

Figure 9:
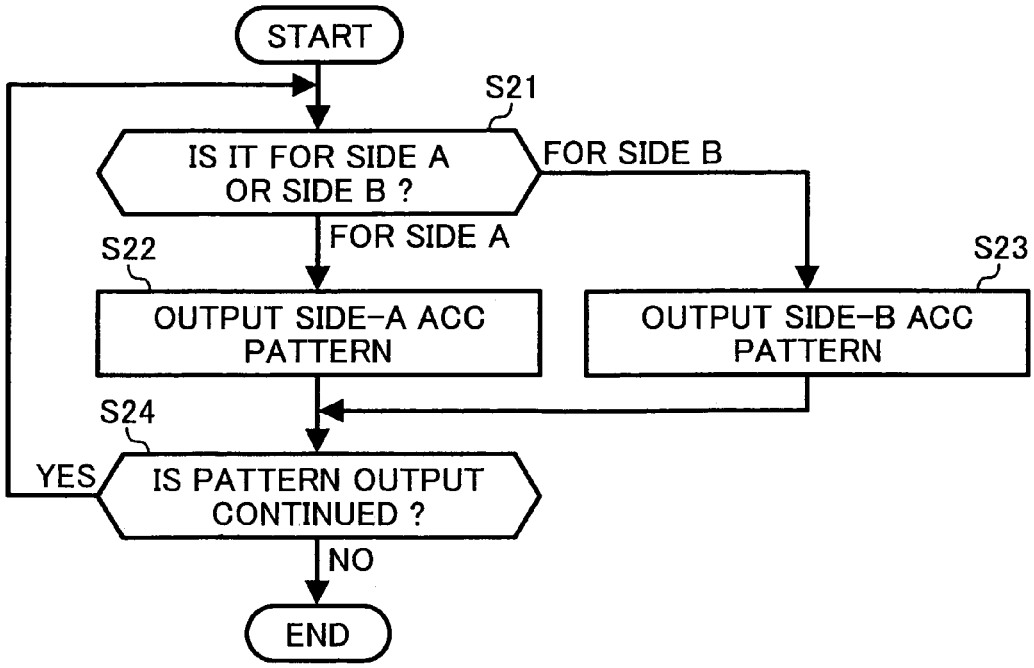
FIG. 9 is a detailed flowchart of an operation at step S2 in FIG. 4.

The operation of outputting an ACC pattern at the step S2 will be explained with reference to FIG. 9.

When the A-side ACC pattern is to be output (step S21; for side A), the visible image of the A-side ACC pattern formed by the image forming unit G is transferred onto the side A (the top side) of the recording medium P from the intermediate transfer belt 10 in the above-described manner, thereby forming an ACC pattern (step S22).

When the B-side ACC pattern is to be output (step S21; for side B), the visible image of the B-side ACC pattern formed by the image forming unit G is transferred onto the side B (the back side) of the recording medium P from the back-side intermediate transfer belt 100 via the intermediate transfer belt 10 in the above-described manner, thereby forming an ACC pattern (step S23). It is determined whether the output of the ACC pattern should continue or not (step S24). When the decision is affirmative (YES at step S24), the flow returns to step S21, whereas when the decision is negative (NO at step S24), the flow is terminated.

Figure 10:
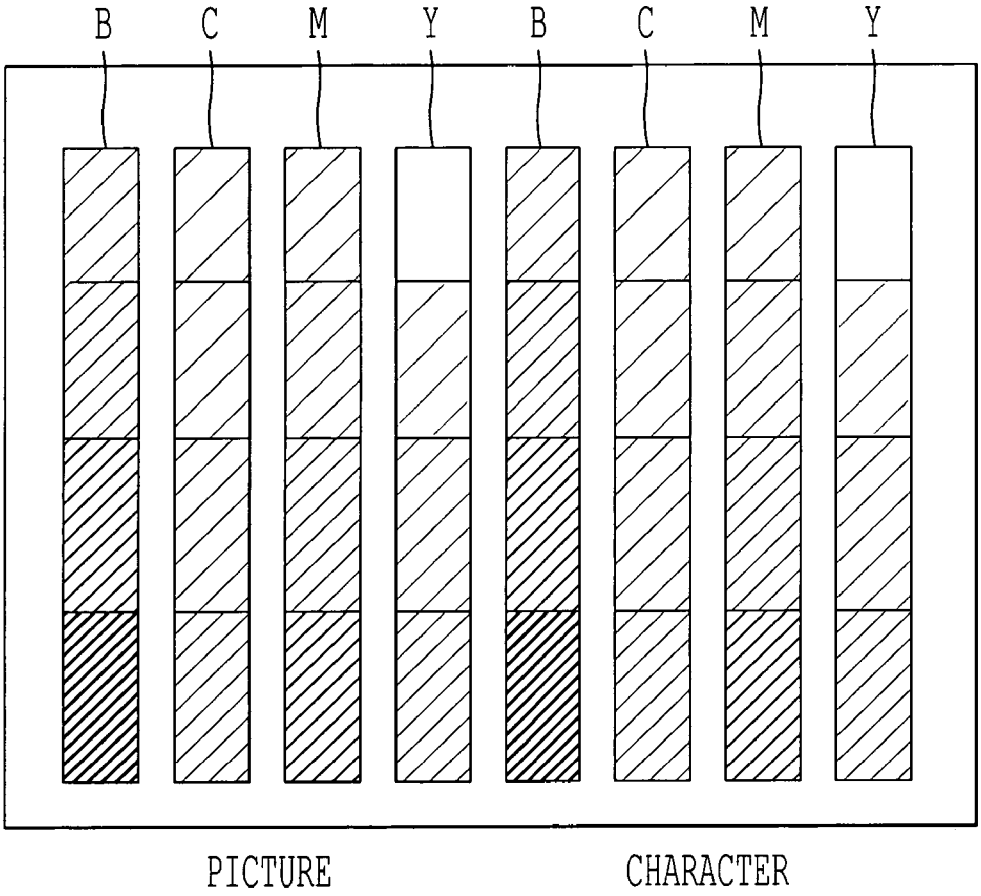
FIG. 10 is a schematic for illustrating an example of the ACC pattern according to a first embodiment of the present invention.

FIG. 10 is a schematic for illustrating an example of the ACC pattern. Gradation patterns corresponding to toners of individual colors of black (B), cyan (C), magenta (M), and yellow (Y) are output by performing image processings for characters and pictures.

Figure 11A:
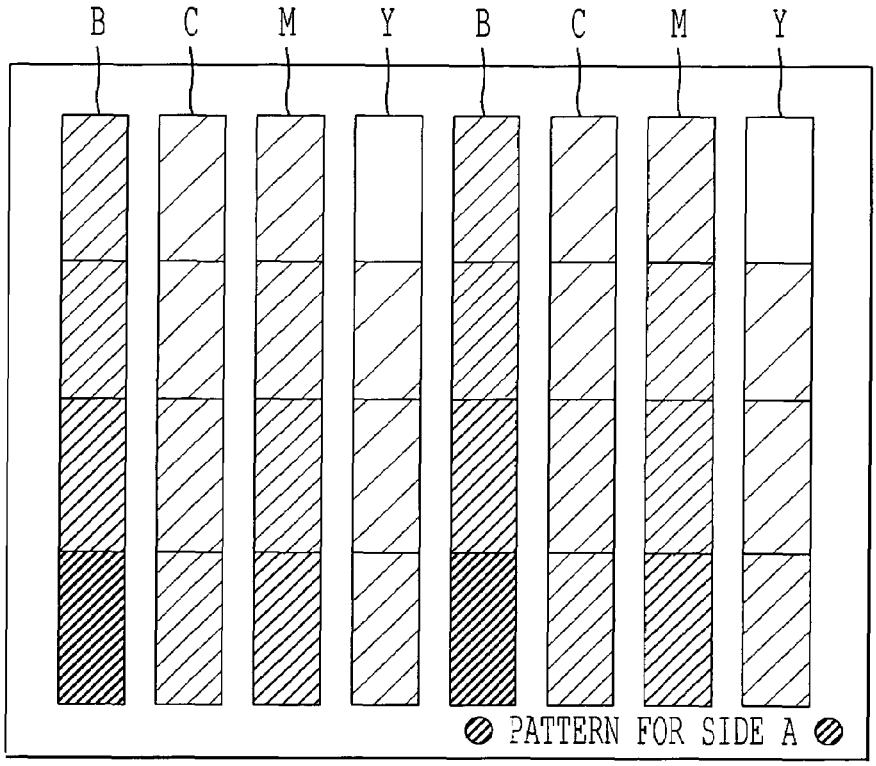
FIGS. 11A and 11B are schematics for illustrating a state in which a side identification pattern is formed in the ACC pattern.
Figure 11B:
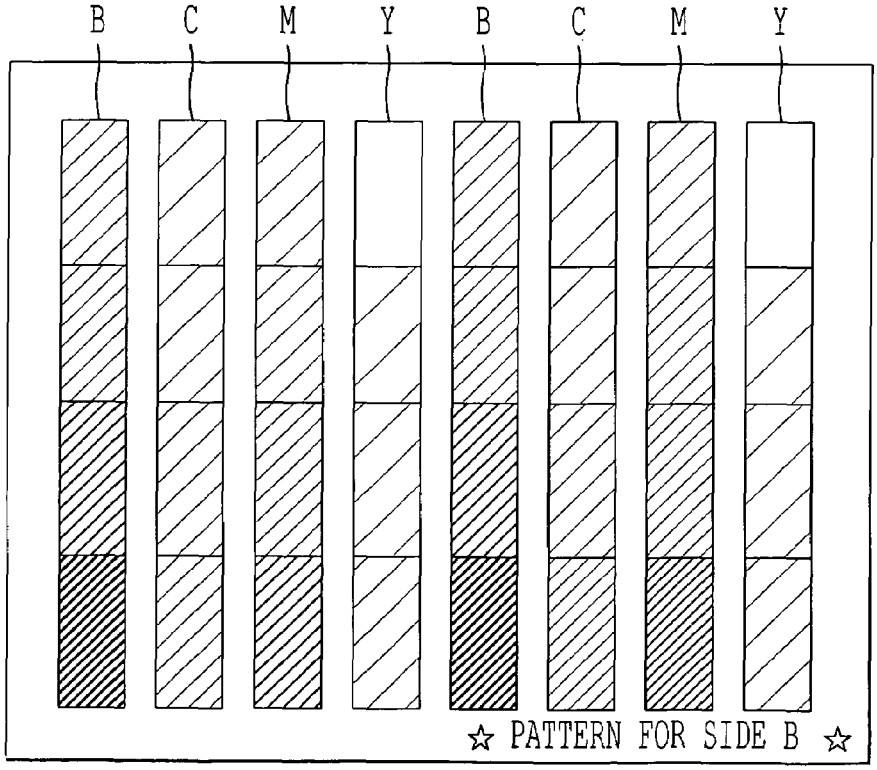

As shown in FIGS. 11A and 11B, an identification (ID) pattern for identifying whether the ACC pattern is for the side A or for the side B is printed (formed) at the peripheral portion of the ACC pattern on the recording medium at the time of forming the ACC pattern. FIG. 11A depicts an ACC pattern for the side A and FIG. 11B depicts an ACC pattern for the side B.

As shown in FIGS. 11A and 11B, the ID pattern is comprised of a text "pattern for *" for a user to identify whether the pattern is for the side A or for the side B, and a symbol for the image processor 302 to automatically identify the side, read by the image reading unit 60, from the read image signal, and is printed outside the ACC pattern.

The ID patterns shown in FIGS. 11A and 11B are just an example, and various ID patterns, such as a pattern using only characters, a pattern using only a symbol, and a pattern using a bar code, may be used selectively according to the purpose.

Figure 12:
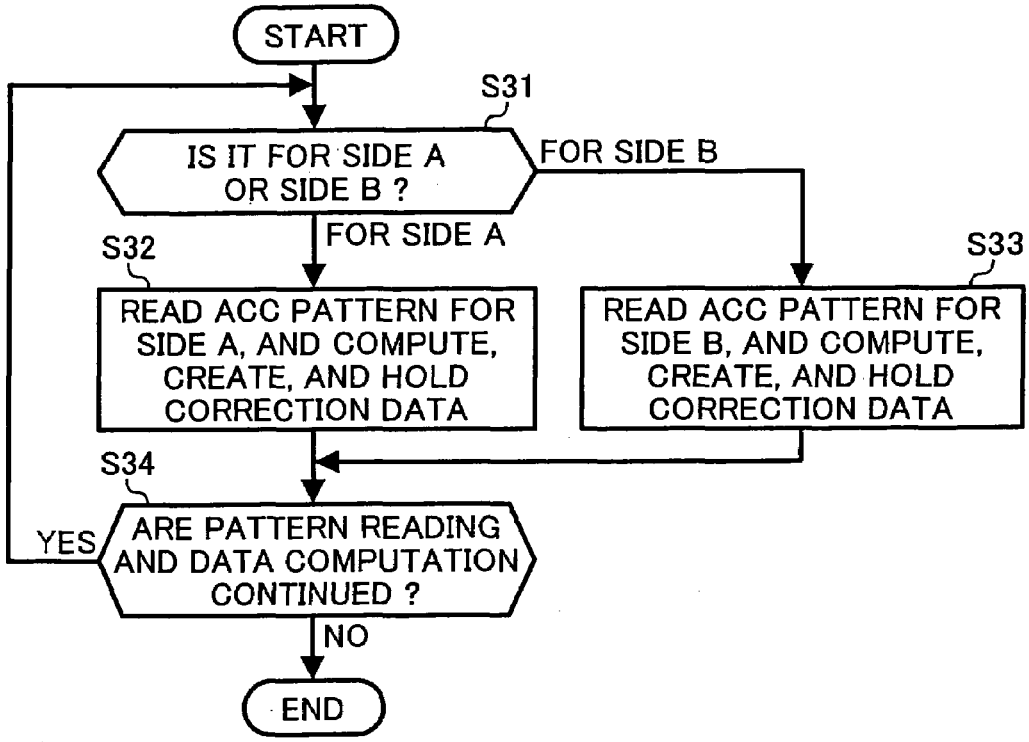
FIG. 12 is a detailed flowchart of an operation at step S3 in FIG. 4.

The reading of the ACC pattern, data computation and creation, and data storage operation at the step S3 is explained below with reference to FIG. 12.

When the A-side ACC pattern is read (step S31; for side A), ACC data computed and created by the image processor 302 after reading is stored in the data storage unit 303 as data for the side A (step S32).

When the B-side ACC pattern is read (step S31; for side B), on the other hand, ACC data computed and created by the image processor 302 after reading is stored in the data storage unit 303 as data for the side B (step S33). It is determined whether the reading of the ACC pattern and the computation and holding of the ACC data should continue or not (step S34). When the decision is affirmative (YES at step S34), the flow returns to step S31, whereas when the decision is negative (NO at step S34), the flow is terminated.

In automatically identifying whether the read ACC pattern is for the side A or for the side B from the ID pattern at the time of reading the ACC pattern, the image processor 302 automatically identifies whether the ACC pattern is for the side A or for the side B based on the ID pattern from the read image signal input from the image reading unit 60.

According to the result of the automatic identification, the image forming apparatus automatically selects whether the ACC pattern is for the side A or for the side B at the step S31.

When the automatic identification is executed at the time of reading the ACC pattern, the ID pattern should have a symbol for automatic identification but may or may not have characters for a user to make the identification.

When a user is instructed to set the A-side ACC pattern or the B-side ACC pattern on the document table in a readable manner by visual means like the screen as shown in FIGS. 7A and 7B or acoustic means like voice generation from the speaker, the ID pattern has character information for the user to make the identification. Accordingly, the user identifies that the printed test pattern (ACC pattern) is for the side A or for the side B and selects whether the ACC pattern is for the side A or for the side B at the step S31.

Figure 13:
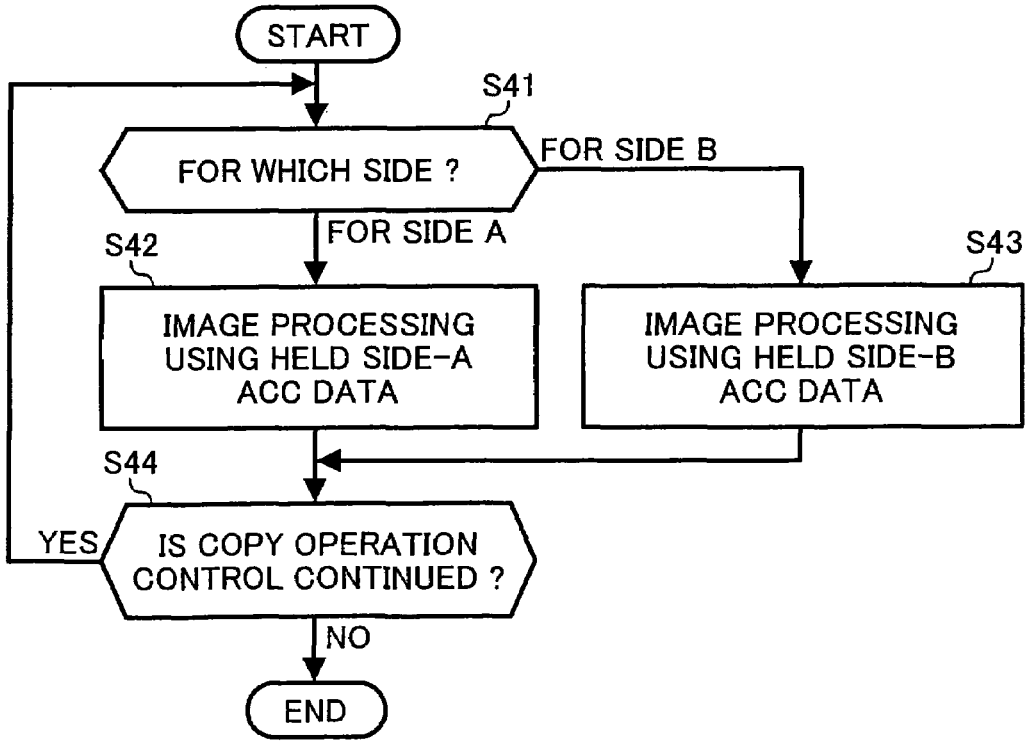
FIG. 13 is a detailed flowchart of an operation at step S4 in FIG. 4.

The copy operation control at the step S4 is explained next with reference to FIG. 13.

When an image for performing a copy output to the side A is formed (step S41: side A), the image processor 302 performs image processing (image quality adjustment) such as gradation correction using the A-side ACC data stored in the data storage unit 303, the image forming unit G forms the image signal as a visible image after the image processing and transfers the visible image onto the side A (the top side) of the recording medium P from the intermediate transfer belt 10 under the control of the system control unit 301 (step S42).

When an image for performing a copy output to the side B is formed (step S41: side B), the image processor 302 performs image processing (image quality adjustment) such as gradation correction using the B-side ACC data stored in the data storage unit 303, the image forming unit G forms the image signal as a visible image after the image processing and transfers the visible image onto the side B (the back side) of the recording medium P from the back-side intermediate transfer belt 100 via the intermediate transfer belt 10 under the control of the system control unit 301 (step S43). It is determined whether the image processing (copy operation control) using the ACC data should continue or not (step S44). When the decision is affirmative (YES at step S44), the flow returns to step S41, whereas when the decision is negative (NO at step S44), the flow is terminated.

According to the first embodiment, when full-color double-side printing is executed using two visible-image carrying units (the intermediate transfer belt 10 and the back-side intermediate transfer belt 100), a difference in image quality originated from the number of image transfers, the procedures of forming a visible image by toners, and time-variant characteristics may occur on the images on each side formed by the respective visible-image carrying units, but the quality of each image can be corrected for each visible-image carrying unit, while compensating for the difference in the qualities of images formed by the visible-image carrying units, by reading the ACC patterns output to both sides, creating color correction data (ACC data) which depends on the respective visible-image carrying units, and performing double-side printing based on the color correction data. This can always ensure high-quality images to be formed on both sides.

The image forming apparatus according to the first embodiment can perform image quality correction while keeping the precision of the image quality correction on both sides of a recording medium (sheet of paper or the like) uniform even in an image forming system which is so designed as to perform double-side printing without having exclusive image forming unit, transfer unit, and fixing unit for printing of each side of the recording medium.

Since a single recording medium is used for printing an image-quality correction test pattern (ACC pattern) for each side, it is possible to use the entire side of the recording medium for printing the test pattern for each side so that the pattern for gradation correction can be made large. Further, it may be used for image-quality correction to detect a difference in image quality originated from the position on the recording medium.

At the time the image forming apparatus reads an output ACC pattern, a user may not clearly distinguish whether the pattern is the A-side ACC pattern formed by the intermediate transfer belt 10 or the B-side ACC pattern formed by the back-side intermediate transfer belt 100. Since an ID pattern to identify whether the ACC pattern is for the side A or for the side B is printed outside the ACC pattern, however, the user can easily distinguish between the A-side ACC pattern and the B-side ACC pattern, which can prevent the user from mistaking the proper side at the time of reading the ACC pattern.

Since the image reading unit 60 automatically identifies from the ID pattern whether the ACC pattern is for the side A or for the side B at the time of reading the ACC pattern, the user can use the ACC pattern without being aware of the A-side ACC pattern or the B-side ACC pattern, which prevents the user from mistaking the proper side at the time of reading the ACC pattern.

Since the user is instructed to place the ACC pattern on the document table by visual means of the image on the touch panel 71 or voice-oriented acoustic means at the time of reading the ACC pattern, the user can easily discriminate whether reading for the pattern A or reading for the pattern B will take place at the time of creating ACC data (at the time of reading the ACC pattern). This function can eliminate the automatic identification function and can lead to cost down by as much as the cost for the automatic identification function.

According to the image forming apparatus, as shown in FIG. 1, the number of transfers of toner images for the back-side intermediate transfer belt 100 located on the right side in the diagram is greater by one than the transfer number for the intermediate transfer belt 10, therefore, the degree of degradation of images to be printed by both transfer belts may become different. In this respect, the image forming apparatus is constructed in such a way as to be able to perform the ACC operation not only for both intermediate belts or both sides of the recording medium but also only for one side whose image would be degraded severely. In this case, it is desirable that the system control unit 301 should selectively perform the ACC operation only for that side where the ACC operation is performed by controlling the charging device 3, the exposure device 4, the developing device 5, the intermediate transfer belt 10, and the back-side intermediate transfer belt 100, so that image-quality correction can be performed only for the image-degraded side.

The image forming apparatus equipped with a transfer mechanism that transfers images to both sides of a recording medium almost simultaneously can perform image-quality correction, such as automatic color correction, accurately and efficiently.

When an image-quality correction test pattern is printed, the printed image-quality correction test pattern is placed on the contact glass 62 by a user and is read by the image reading unit 60. The structure may be modified in such a way that a correction conveyance path (not shown) may be provided for directly conveying the recording paper having the ACC pattern printed thereon to the image reading unit 60. According to the modification, the ACC pattern is automatically printed at the same time as setting for pattern reading is input without intervention of a user, the ACC pattern is read by the image reading unit 60, and information on the read ACC pattern is compared with the correction pattern information to determine the image quality which is automatically corrected. Accordingly, merely setting the start of printing of the ACC pattern can lead to automatic ACC process.

A case of color printing is explained above, but the present invention can be adapted to monochromatic double-side printing.

The image forming apparatus can also be adapted to a system which uses an auto document feeder (ADF), not shown, in which case, the image forming apparatus has a conveyance path (not shown) along which the recording medium is fed from the ADF to the transfer unit for image transfer.

A second embodiment of the present invention has a function of printing an ACC pattern (test pattern) to be used for automatic color correction for double-side printing on both sides of the recording medium and reading the ACC pattern at a time in addition to the functions of the first embodiment.

The outline of the control for ACC in the image forming apparatus according to the present embodiment is such that the outputting of the ACC pattern at step S2 in the ACC operation in the first embodiment discussed with reference to FIG. 4 is output in double-side printing mode, and with regard to the reading of the ACC pattern at step S3, ACC patterns on both sides may be read simultaneously and automatically identified.

In the ACC, as mentioned earlier, the A-side ACC pattern is transferred onto the side A (the top side) of a single recording medium by the intermediate transfer belt 10, the B-side ACC pattern is transferred onto the side B (the back side) of the recording medium by the back-side intermediate transfer belt 100, and the ACC patterns are read, thereby creating color correction data which depends on the respective visible-image carrying units.

The operation of outputting an ACC pattern at the step S2 will be explained with reference to FIG. 9.

When the A-side ACC pattern is to be output (step S21; for side A), the visible image of the A-side ACC pattern formed by the image forming unit G is transferred onto the side A (the top side) of the recording medium P from the intermediate transfer belt 10 in the above-described manner, thereby forming an ACC pattern (step S22).

When the B-side ACC pattern is to be output (step S21; for side B), the visible image of the B-side ACC pattern formed by the image forming unit G is transferred onto the side B (the back side) of the recording medium P from the back-side intermediate transfer belt 100 via the intermediate transfer belt 10 in the above-described manner, thereby forming an ACC pattern (step S23).

The transfer of the A-side ACC pattern and the transfer of the B-side ACC pattern to the recording medium P are carried out almost simultaneously by the double-side printing method.

Figure 14:
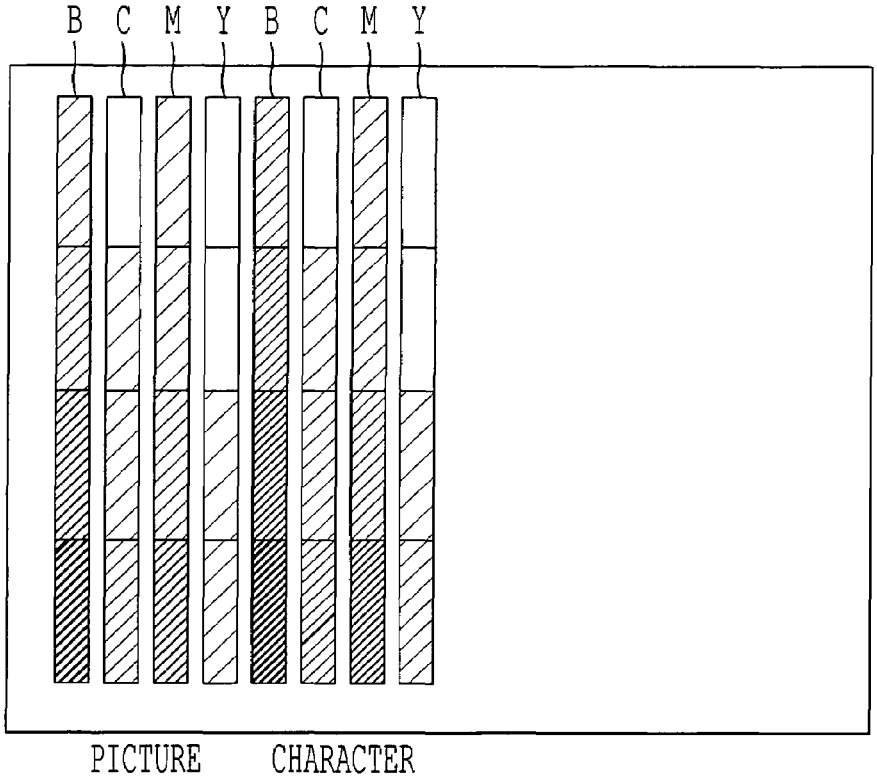
FIG. 14 is a schematic for illustrating an example of an ACC pattern according to a second embodiment.

FIG. 14 is a schematic for illustrating an example of an ACC pattern according to the second embodiment. Gradation patterns corresponding to toners of individual colors of black (B), cyan (C), magenta (M), and yellow (Y) are output by performing image processings for characters and pictures.

Figure 15:
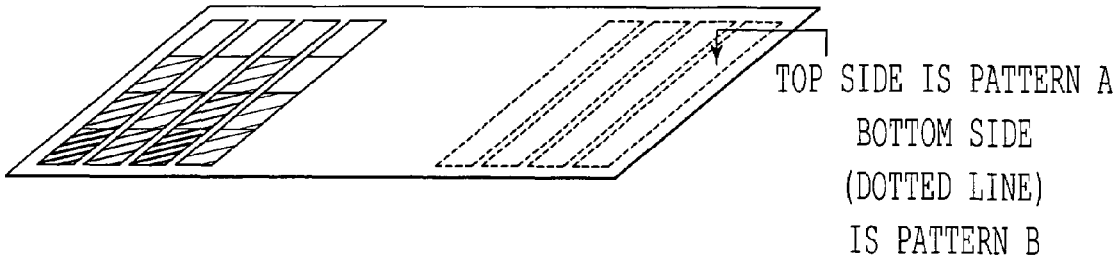
FIG. 15 is a schematic for illustrating a positional relationship of the ACC pattern on each side.

The gradation pattern (ACC pattern) corresponding to toners of each color is formed on individual sides of the recording medium P at positions different from each other (positions where patterns do not overlie each other through the sheet back to front), as shown in FIG. 15. That is, the ACC patterns are formed in such a way that even if the recording medium P on which the ACC patterns are formed is seen through, the ACC patterns corresponding to the individual sides do not overlie each other.

This can prevent the ACC pattern at the back side from being read through the sheet at the time of reading the ACC pattern at the top side.

Figure 16A:
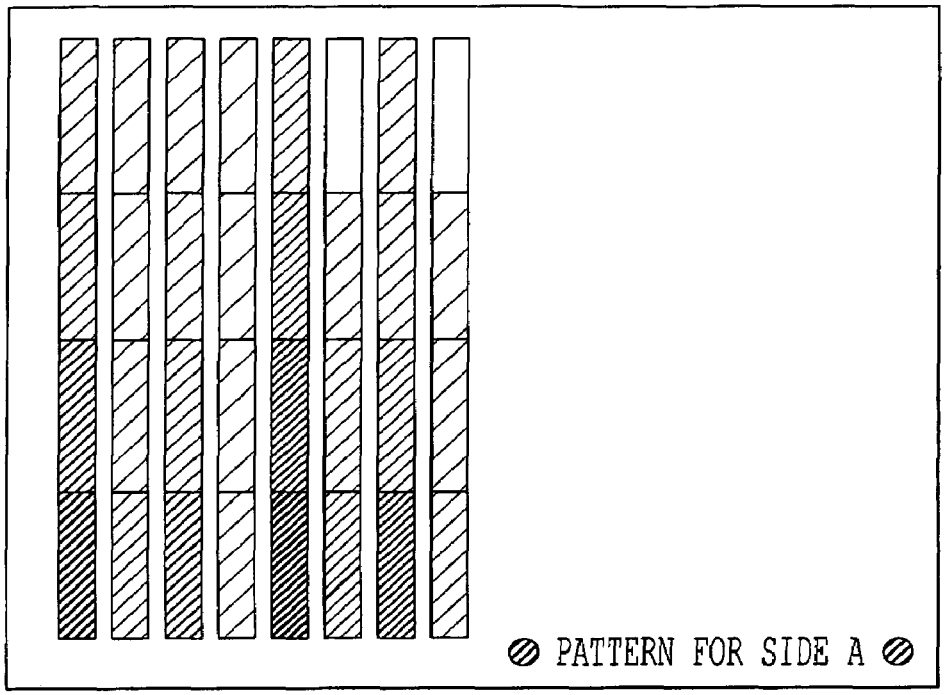
FIGS. 16A and 16B are schematics for illustrating a state in which a side identification pattern is formed in the ACC pattern.
Figure 16B:
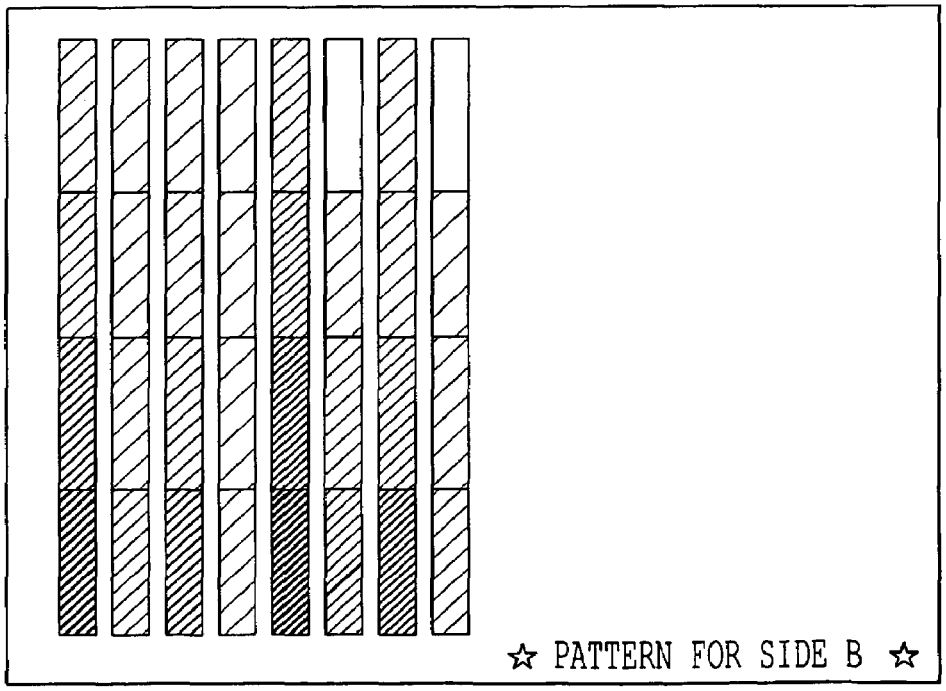

As shown in FIGS. 16A and 16B, an ID pattern for identifying whether the ACC pattern is for the side A or for the side B is printed (formed) at the peripheral portion of the ACC pattern on the recording medium at the time of forming the ACC pattern. FIGS. 16A and 16B are schematics for illustrating a state in which a side identification pattern is formed in the ACC patterns for side A and B, respectively.

As shown in FIGS. 16A and 16B, the ID pattern is composed of a text "pattern for *" for a user to identify whether the pattern is for the side A or for the side B, and a symbol for the image processor 302 to automatically identify the side, read by the image reading unit 60, from the read image signal, and is printed outside the ACC pattern.

The ID patterns shown in FIGS. 16A and 16B are just an example, and various ID patterns, such as a pattern using only characters, a pattern using only a symbol, and a pattern using a bar code, may be used selectively according to the purpose.

The reading of the ACC pattern, data computation and creation, and data storage operation at the step S3 is explained next with reference to FIG. 12.

When the A-side ACC pattern is read (step S31; for side A), ACC data computed and created by the image processor 302 after reading is stored in the data storage unit 303 as data for the side A (step S32).

When the B-side ACC pattern is read (step S31; for side B), on the other hand, ACC data computed and created by the image processor 302 after reading is stored in the data storage unit 303 as data for the side B (step S33).

In automatically identifying whether the read ACC pattern is for the side A or for the side B from the ID pattern at the time of reading the ACC pattern, the image processor 302 automatically identifies whether the ACC pattern is for the side A or for the side B based on the ID pattern from the read image signal input from the image reading unit 60.

Accordingly, when the ACC pattern is read by the automatic identification function, a user has only to set a single recording medium P having the ACC pattern formed thereon in an ADF 61 of the image reading unit 60 and press the start button, after which the image forming apparatus according to the present embodiment continuously scans both sides of the recording medium P and the image processor 302 automatically identifies the side A or the side B and computes the ACC data, and the generated ACC data for each side is stored in the data storage unit 303.

When the automatic identification is executed at the time of reading the ACC pattern, the ID pattern should have a symbol for automatic identification but may or may not have characters for a user to make the identification.

When a user is instructed to set the A-side ACC pattern or the B-side ACC pattern on the document table in a readable manner by visual means like the screen as shown in FIGS. 7A and 7B or acoustic means like voice generation from the speaker, the ID pattern has character information for the user to make the identification. Accordingly, the user identifies that the printed test pattern (ACC pattern) is for the side A or for the side B and selects whether the ACC pattern is for the side A or for the side B at the step S31.

The copy operation control at the step S4 is explained next with reference to FIG. 13.

When an image for performing a copy output to the side A is formed (step S41: side A), the image processor 302 performs image processing (image quality adjustment) such as gradation correction using the A-side ACC data stored in the data storage unit 303, the image forming unit G forms the image signal as a visible image after the image processing and transfers the visible image onto the side A (the top side) of the recording medium P from the intermediate transfer belt 10 under the control of the system control unit 301 (step S42).

When an image for performing a copy output to the side B is formed (step S41: side B), the image processor 302 performs image processing (image quality adjustment) such as gradation correction using the B-side ACC data stored in the data storage unit 303, the image forming unit G forms the image signal as a visible image after the image processing and transfers the visible image onto the side B (the back side) of the recording medium P from the back-side intermediate transfer belt 100 via the intermediate transfer belt 10 under the control of the system control unit 301 (step S43).

According to the second embodiment, when full-color double-side printing is executed using two visible-image carrying units (the intermediate transfer belt 10 and the back-side intermediate transfer belt 100), a difference in image quality originated from the number of image transfers, the procedures of forming a visible image by toners, and time-variant characteristics may occur, on the images on each side formed by the respective visible-image carrying units, but the quality of each image can be corrected for each visible-image carrying unit, while compensating for the difference in the qualities of images formed by the visible-image carrying units, by reading the ACC patterns output to both sides of the single recording medium P, creating color correction data (ACC data) which depends on the respective visible-image carrying units, and performing double-side printing based on the color correction data. This can always ensure high-quality images to be formed on both sides.

Since the image-quality correction test pattern (ACC pattern) for each side is formed on a corresponding side of a single recording medium, the amount of a recording medium such as paper used in the ACC operation can be reduced as much as possible and the time required for the printing of the ACC pattern can be shortened as much as possible.

Since the A-side ACC pattern and the B-side ACC pattern to be formed on the respective sides of the recording medium P are formed at different places on the top side and the back side, it is possible to prevent the pattern on the back side from being read through the sheet at the time of reading the ACC pattern on the top side. This can ensure high image-quality correction.

At the time the image forming apparatus reads an output ACC pattern, a user may not clearly distinguish whether the pattern is the A-side ACC pattern formed by the intermediate transfer belt 10 or the B-side ACC pattern formed by the back-side intermediate transfer belt 100. Since an ID pattern to identify whether the ACC pattern is for the side A or for the side B is printed outside the ACC pattern, however, the user can easily distinguish between the A-side ACC pattern and the B-side ACC pattern, which can prevent the user from mistaking the proper side at the time of reading the ACC pattern.

Since the image reading unit 60 automatically identifies from the ID pattern whether the ACC pattern is for the side A or for the side B at the time of reading the ACC pattern, the user can use the ACC pattern without being aware of the A-side ACC pattern or the B-side ACC pattern, which prevents the user from mistaking the proper side at the time of reading the ACC pattern.

Since the user is instructed to place the ACC pattern on the document table by visual means of the image on the touch panel 71 or voice-oriented acoustic means at the time of reading the ACC pattern, the user can easily discriminate whether reading for the pattern A or reading for the pattern B will take place at the time of creating ACC data (at the time of reading the ACC pattern). This function can eliminate the automatic identification function and can lead to cost down by as much as the cost for the automatic identification function.

The image forming apparatus equipped with a transfer mechanism that transfers images to both sides of a recording medium almost simultaneously can perform image-quality correction, such as automatic color correction, accurately and efficiently.

The embodiments described above are only exemplary and can be modified in various ways without departing from the scope and spirit of the invention.

For example, the photoconductor 1 is not limited to a cylinder type shown in FIG. 1, but may be a belt-like photoconductor.

Although the A-side ACC pattern and the B-side ACC pattern are continuously output at the time of outputting the ACC patterns in the above embodiments, the image forming apparatus may further include a function of outputting only the A-side ACC pattern or the B-side ACC pattern according to the selection made by a user.

In this case, the image forming apparatus demands a user of setting only the test pattern (ACC pattern) for the pattern-output side through the touch panel 71 or by a voice generated from the speaker at the time of reading the ACC pattern.

The time of the application of ACC in the present embodiments is not limited to the copying time as in the respective embodiments, and when the image forming apparatus according to the present invention is used as a printer to print image data input from another device, ACC may be carried out at the time of such printing.

Although the above embodiments explain about the formation of a color image using toners of plural colors, various kinds of image-quality correction can be performed as mentioned earlier. For the formation of a monochromatic image, for example, corresponding image-quality correction can be performed.

An image processing unit according to a third embodiment of the present invention executes the image processing function of the image forming apparatus according to the first embodiment.

The system control unit 301, the image processor 302, the data storage unit 303, and the reference pattern information holding unit 302*a* shown in FIG. 2 constitute the image processing unit according to the third embodiment. Since explanation for the image processing unit according to the third embodiment is mainly described in the above explanation for the image processing unit or the essential function of the image forming apparatus according to the first embodiment, the explanation of the image processing unit according to the third embodiment will be omitted. The image processing unit according to the third embodiment can be constructed by the image processing unit or the essential function of the image forming apparatus according to the second embodiment. Since the image processing unit of the image forming apparatus according to the second embodiment is already explained above in the second embodiment, its description will not be repeated.

The image processing unit in the image forming apparatus equipped with a transfer mechanism that transfers images to both sides of a recording medium almost simultaneously can perform image-quality correction, such as automatic color correction, accurately and efficiently.

While the image processing unit in the image forming apparatus according to the present embodiment is designed to be able to perform double-side printing without using a double-side inverting sheet feeder, once the image-quality correction pattern for each side is read by the reading unit, the image quality on each side can be adjusted based on data of the read image-quality correction pattern at the time of later double-side printing. Therefore, image-quality correction can be carried out with a uniform precision of correcting the image qualities on both sides of the recording medium.

Figure 17:
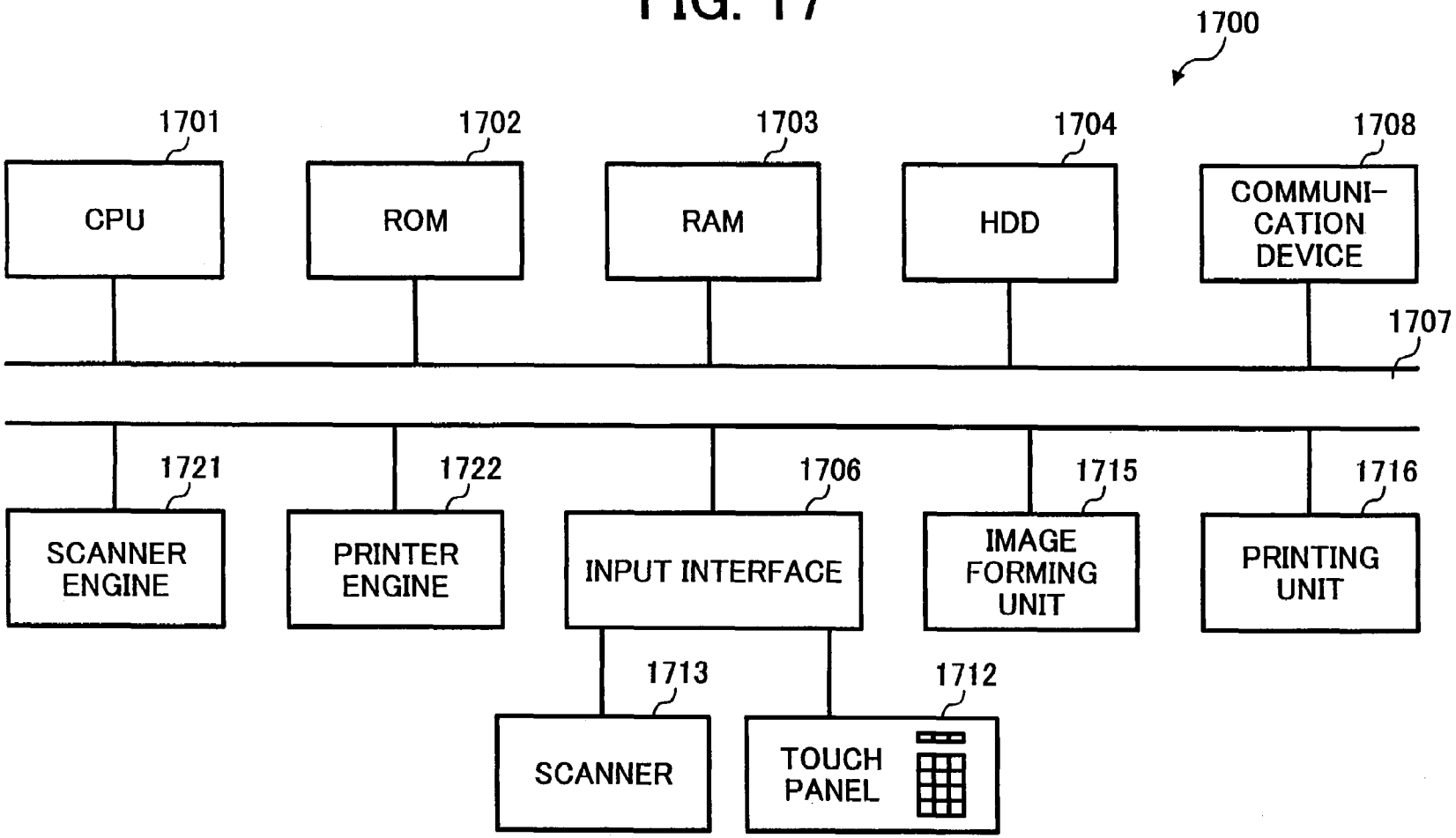
FIG. 17 is a block diagram of a hardware configuration of an image forming apparatus according to the present embodiment.

FIG. 17 is a block diagram of a hardware configuration of an image forming apparatus according to the embodiments of the present embodiment. The image forming apparatus according to the present embodiment has a control device, such as a central processing unit (CPU) 1701, a memory device, such as a ROM 1702 and a random access memory (RAM) 1703, an external memory device, such as an hard disk drive (HDD) 1704 and a CD drive, an input interface 1706 and a touch panel 1712, which are the operation/display unit, and mechanical devices, such as a scanner 1713, an image forming unit 1715, a printing unit 1716, a scanner engine 1721, and a printer engine 1722, which carry out mechanical operations. That is, the image forming apparatus has a hardware configuration using an ordinary computer.

An image forming program which makes a computer of the image forming apparatus execute the individual steps or the functions of the individual units or devices described above is stored in the ROM 1702.

The image forming program may be provided as a file of an installable form or an executable form recorded on a computer readable storage medium, such as a CD-ROM, a flexible disk (FD), a CD-R, or a DVD (Digital Versatile Disk). In this case, as the CPU 1701 reads the image forming program from the storage medium and loads the program on the main memory device, the image forming apparatus accomplishes the individual steps or the functions of the individual units or devices.

The image forming program may be installed in a computer connected to a network such as the Internet, and be provided by downloading though the network. Alternatively, the image forming program may be provided or distributed through the network such as the Internet.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

an image forming unit configured to form a first visible image based on input image information;

a first visible-image carrying unit configured to receive the first visible image from the image forming unit, to form a second visible image, and configured to carry the second visible image;

a second visible-image carrying unit configured to receive the second visible image from the first visible-image carrying unit, to form a third visible image, and configured to carry the third visible image;

a printing unit configured to perform printing by transferring the second visible image to one side of a recording medium and transferring the third visible image to another side of the recording medium, wherein the first visible-image carrying unit is configured to transfer the second visible image to the recording medium and the second visible-image carrying unit is configured to transfer the third visible image to the recording medium;

a control unit configured to control the image forming unit, the first visible-image carrying unit, the second visible-image carrying unit, and the printing unit based on correction pattern information configured to print a pattern image for correcting image quality on at least either side of the recording medium, the correction pattern information being a basis of the pattern image for correcting image quality transferred to the at least either side of the recording medium; and a reading unit configured to read information of the pattern image for correcting image-quality printed on the recording medium, wherein when the reading unit reads the information of the pattern image for correcting image quality printed on the at least either side of the recording medium, the control unit compares the information of the pattern image for correcting image-quality with the correction pattern information, and controls the image forming unit based on a result of the comparison to correct the image quality on the at least either side of the recording medium.

2. The image forming apparatus according to claim 1, wherein the first and second visible image carrying unit form a transfer nip, configured to transfer the second and third visible image from either the first and second visible image carrying unit.

3. The image forming apparatus according to claim 1, wherein the control unit is configured to control a print of the pattern image for correcting image quality on each side of the recording medium based on the correction pattern information corresponding to each side of the recording medium, and when the reading unit reads the pattern image for correcting image quality printed on each side of the recording medium, the control unit compares the pattern image for correcting image quality with the correction pattern information corresponding to each side of the recording medium, and controls the image forming unit based on a result of the comparison to correct the image quality on each side of the recording medium.

4. The image forming apparatus according to claim 1, wherein the image forming unit is configured to form the first visible image based on image information read by the reading unit.

5. The image forming apparatus according to claim 1, wherein the control unit is configured to control an output of the pattern images for correcting image quality corresponding to each side of the recording medium on a single side of two recording media, respectively.

6. The image forming apparatus according to claim 5, wherein the control unit is configured to control the image forming unit to form an identification pattern for identifying a side of the recording medium, for which the pattern image for correcting image quality is formed, on an outer peripheral portion of the pattern image for correcting image quality, with respect to the two recording media.

7. The image forming apparatus according to claim 6, wherein when the reading unit reads the pattern image for correcting image quality printed on each side of the recording medium, the control unit automatically identifies the side of the recording medium, for which the pattern image for correcting image quality is formed, from information on the identification pattern in the information of the pattern image for correcting image quality.

8. The image forming apparatus according to claim 4, wherein the control unit is configured to control an output of the pattern image for correcting image quality corresponding to each side of the recording medium on a corresponding side of a single recording medium.

9. The image forming apparatus according to claim 8, wherein the pattern images for correcting image quality are formed in such a manner that the pattern image for correcting image quality on the one side of the recording medium does not overlap with the pattern image for correcting image quality on the other side of the recording medium through the recording medium.

10. The image forming apparatus according to claim 8, wherein the control unit is configured to control the image forming unit to form an identification pattern for identifying a side of the recording medium, for which the pattern image for correcting image quality is formed, on an outer peripheral portion of the pattern image for correcting image quality, with respect to each side of the single recording medium.

11. The image forming apparatus according to claim 10, wherein when the reading unit reads the pattern image for correcting image quality printed on each side of the recording medium, the control unit automatically identifies the side of the recording medium, for which the pattern image for correcting image quality is formed, from information on the identification pattern in the information of the pattern image for correcting image quality.

12. The image forming apparatus according to claim 1, wherein the control unit includes a display unit configured to display visually, when the reading unit reads the pattern image for correcting image quality printed on each side of the recording medium, whether the side of the recording medium, to which the pattern image for correcting image is output, should be set in a readable state by the reading unit.

13. The image forming apparatus according to claim 1, wherein the control unit includes a voice output unit configured to indicate with a voice, when the reading unit reads the pattern image for correcting image quality printed on each side of the recording medium, whether the side of the recording medium, to which the pattern image for correcting image is output, should be set in a readable state by the reading unit.

14. An image processing unit for an image forming apparatus that includes:

a reading unit configured to read image information, an image forming unit configured to form a first visible image based on the image information input, a first visible-image carrying unit configured to receive the first visible image from the image forming unit, to form a second visible image, and configured to carry the second visible image, a second visible-image carrying unit configured to receive the second visible image from the first visible-image carrying unit, to form a third visible image, and configured to carry the third visible image, and a printing unit configured to perform printing by transferring the second visible image to one side of a recording medium and transferring the third visible image to another side of the recording medium, wherein the first visible-image carrying unit is configured to transfer the second visible image to the recording medium and the second visible-image carrying unit is configured to transfer the third visible image to the recording medium, the image processing unit comprising, a control unit configured to control the image forming unit, the first visible-image carrying unit, the second visible-image carrying unit, and the printing unit based on correction pattern information to print a pattern image for correcting image quality on at least either side of the recording medium, the correction pattern information being a basis of the pattern image for correcting image quality transferred to the at least either side of the recording medium, wherein when the reading unit reads the information of the pattern image for correcting image quality printed on the at least either side of the recording medium, the control unit compares the information of the pattern image for correcting image-quality with the correction pattern information, and controls the image forming unit based on a result of the comparison to correct the image quality on the at least either side of the recording medium.

15. The image processing unit according to claim 14, wherein the control unit is configured to control a print of the pattern image for correcting image quality on each side of the recording medium based on the correction pattern information corresponding to each side of the recording medium, and when the reading unit reads the pattern image for correcting image quality printed on each side of the recording medium, the control unit compares the pattern image for correcting image quality with the correction pattern information corresponding to each side of the recording medium, and controls the image forming unit based on a result of the comparison to correct the image quality on each side of the recording medium.

16. An image forming method comprising:

forming a first visible image based on input image information;

transferring the first visible image to a first visible-image carrying unit so as to form a second visible image, and carrying the second visible image;

further transferring the second visible image to a second visible-image carrying unit so as to form a third visible image, and carrying the third visible image;

performing printing by transferring the second visible image from the first visible-image carrying unit to one side of a recording medium and transferring the third visible image from the second visible-image carrying unit to an other side of the recording medium, the performing printing being executed while the recording medium passes between the first and second visible-image carrying units;

controlling the forming, the transferring, the further transferring, and the performing based on correction pattern information to print a pattern image for correcting image quality on at least either side of the recording medium, the correction pattern information being a basis of the pattern image for correcting image quality transferred to the at least either side of the recording medium; and reading information of the pattern image for correcting image-quality printed on the recording medium, wherein when the information of the pattern image for correcting image quality printed on the at least either side of the recording medium is read at the reading, the controlling includes comparing the information of the pattern image for correcting image-quality with the correction pattern information and controlling the image forming unit based on a result of the comparing to correct the image quality on the at least either side of the recording medium.

17. The image forming method according to claim 16, wherein the controlling includes controlling to print the pattern image for correcting image quality on each side of the recording medium based on the correction pattern information corresponding to each side of the recording medium, and when the pattern image for correcting image quality printed on each side of the recording medium is read at the reading, the controlling includes comparing the pattern image for correcting image quality with the correction pattern information corresponding to each side of the recording medium, and controls the image forming unit based on a result of the comparison to correct the image quality on each side of the recording medium.

18. The image forming method according to claim 16, wherein the forming includes forming the first visible image based on image information read at the reading.

19. A computer-readable recording medium that stores a computer program for forming an image, the computer program making a computer execute:

forming a first visible image based on input image information;

transferring the first visible image to a first visible-image carrying unit so as to form a second visible image, and carrying the second visible image;

further transferring the second visible image to a second visible-image carrying unit so as to form a third visible image, and carrying the third visible image;

performing printing by transferring the second visible image from first visible-image carrying unit to one side of a recording medium and transferring the third visible image from the second visible-image carrying unit to an other side of the recording medium, the performing printing being executed while the recording medium passes between the first and second visible-image carrying units;

controlling the forming, the transferring, the further transferring, and the performing based on correction pattern information to print a pattern image for correcting image quality on at least either side of the recording medium, the correction pattern information being a basis of the pattern image for correcting image quality transferred to the atleast either side of the recording medium; and reading information of the pattern image for correcting image-quality printed on the recording medium, wherein when the information of the pattern image for correcting image quality printed on the at least either side of the recording medium is read at the reading, the controlling includes comparing the information of the pattern image for correcting image-quality with the correction pattern information and controlling the image forming unit based on a result of the comparing to correct the image quality on the at least either side of the recording medium.

20. The computer-readable recording medium according to claim 19, wherein the controlling includes controlling to print the pattern image for correcting image quality on each side of the recording medium based on the correction pattern information corresponding to each side of the recording medium, and when the pattern image for correcting image quality printed on each side of the recording medium is read at the reading, the controlling includes comparing the pattern image for correcting image quality with the correction pattern information corresponding to each side of the recording medium, and controls the image forming unit based on a result of the comparison to correct the image quality on each side of the recording medium.

* * * * *